US012352032B2

(12) United States Patent
King et al.

(10) Patent No.: US 12,352,032 B2
(45) Date of Patent: Jul. 8, 2025

(54) CHAMBER FOR SUBSOIL FLUID TREATMENT

(71) Applicant: Eljen Corporation, Windsor, CT (US)

(72) Inventors: James M. King, Ellington, CT (US); Scott Moore, Oxford, CT (US); Eric Daniels, Charlton, MA (US)

(73) Assignee: Eljen Corporation, Windsor, CT (US)

( * ) Notice: Subject to any disclaimer, the term of this patent is extended or adjusted under 35 U.S.C. 154(b) by 112 days.

(21) Appl. No.: 18/134,921

(22) Filed: Apr. 14, 2023

(65) Prior Publication Data

US 2023/0332392 A1 Oct. 19, 2023

Related U.S. Application Data

(60) Provisional application No. 63/331,333, filed on Apr. 15, 2022.

(51) Int. Cl.
*E03F 1/00* (2006.01)
*E02B 13/00* (2006.01)

(52) U.S. Cl.
CPC ..... *E03F 1/003* (2013.01)

(58) Field of Classification Search
CPC ..... E03F 1/003; E02B 11/005
See application file for complete search history.

(56) References Cited

U.S. PATENT DOCUMENTS 980,442 A 1/1911 Schlafly
2,637,170 A 5/1953 Benedict
2,803,948 A 8/1957 Dorfman
2,955,523 A * 10/1960 Rasch ..... B65D 88/742 454/182
3,645,100 A 2/1972 La Monica
(Continued)

FOREIGN PATENT DOCUMENTS

CA 1330603 7/1994
CA 2158418 4/1996
(Continued)

OTHER PUBLICATIONS

Cardinal report for patentability search prepared on Oct. 6, 2020; 21 pgs.
(Continued)

*Primary Examiner* — Benjamin F Fiorello
*Assistant Examiner* — Stacy N Lawson
(74) *Attorney, Agent, or Firm* — Alix, Yale & Ristas, LLP

(57) ABSTRACT

Leaching chamber units have an elongated body with a length extending between a closed end and an open end. The closed end of the leaching chamber unit may define one or more fluid flow openings. The elongated body of the leaching chamber unit has an arcuate, arched or convex cross-sectional shape and includes strengthening ribs extending transverse to the length of the elongated body. The strengthening ribs are arranged in a regular, repeating pattern along the length of the elongated body. The repeating pattern and complementary shape of the strengthening ribs allow the disclosed leaching chamber units to be nested for storage and transport. The disclosed leaching chamber units can be mated with each other at a range of longitudinal positions to form leaching chamber assemblies of a desired interior volume and leaching capacity.

16 Claims, 7 Drawing Sheets

(56) References Cited

U.S. PATENT DOCUMENTS

| | | | | |
|---|---|---|---|---|
| 4,188,154 | A | 2/1980 | Izatt | |
| 4,192,628 | A | 3/1980 | Gorman | |
| 4,720,209 | A | 1/1988 | Iams | |
| 4,759,661 | A * | 7/1988 | Nichols | E03F 1/003 405/48 |
| 4,909,665 | A | 3/1990 | Caouette | |
| 5,017,041 | A | 5/1991 | Nichols | |
| 5,087,151 | A | 2/1992 | DiTullio | |
| 5,156,488 | A | 10/1992 | Nichols | |
| 5,336,017 | A | 8/1994 | Nichols | |
| 5,401,459 | A | 3/1995 | Nichols et al. | |
| 5,419,838 | A | 5/1995 | DiTullio | |
| 5,501,547 | A | 3/1996 | Mantelli | |
| 5,511,903 | A | 4/1996 | Nichols et al. | |
| 5,588,778 | A | 12/1996 | Nichols et al. | |
| 5,716,163 | A | 2/1998 | Nichols et al. | |
| 5,773,756 | A | 6/1998 | DiTullio | |
| 5,785,454 | A | 7/1998 | Ringdal et al. | |
| 5,839,844 | A | 11/1998 | Nichols et al. | |
| 5,921,711 | A | 7/1999 | Sipaila | |
| 6,375,388 | B1 | 4/2002 | Zoeller et al. | |
| 6,461,078 | B1 | 10/2002 | Presby | |
| 6,679,653 | B1 | 1/2004 | DiTullio | |
| 6,698,975 | B1 | 3/2004 | Benecke | |
| 6,702,517 | B2 | 3/2004 | Goddard | |
| 6,705,800 | B2 | 3/2004 | Ring et al. | |
| 7,226,241 | B2 | 6/2007 | DiTullio | |
| 7,306,399 | B1 | 12/2007 | Smith | |
| 7,351,005 | B2 | 4/2008 | Potts | |
| 7,374,364 | B2 | 5/2008 | Allard et al. | |
| 7,419,332 | B1 | 9/2008 | Brochu et al. | |
| 7,473,053 | B1 | 1/2009 | Brochu et al. | |
| 7,500,805 | B1 | 3/2009 | Brochu et al. | |
| 7,611,306 | B1 | 11/2009 | Hallahan et al. | |
| 7,857,547 | B1 | 12/2010 | Summers et al. | |
| 7,909,535 | B2 | 3/2011 | Samara | |
| 7,914,230 | B2 | 3/2011 | Moore, Jr. et al. | |
| 7,914,231 | B2 | 3/2011 | Coppes et al. | |
| 8,151,999 | B1 | 4/2012 | Moore, Jr. et al. | |
| 8,297,880 | B2 | 10/2012 | Brochu et al. | |
| 8,322,948 | B2 | 12/2012 | Moore, Jr. et al. | |
| 8,337,119 | B2 | 12/2012 | Burnes et al. | |
| 8,366,346 | B2 | 2/2013 | DiTullio | |
| 8,414,222 | B2 | 4/2013 | DiTullio | |
| 8,491,224 | B2 | 7/2013 | Cobb et al. | |
| 8,501,006 | B2 | 8/2013 | Presby | |
| 8,789,714 | B1 | 7/2014 | Kruger et al. | |
| 8,801,326 | B2 | 8/2014 | Coppes et al. | |
| 8,815,094 | B2 | 8/2014 | Presby | |
| 9,016,979 | B1 | 4/2015 | Coppes et al. | |
| 9,045,873 | B1 | 6/2015 | Moore, Jr. | |
| 9,233,775 | B1 | 1/2016 | Holbrook et al. | |
| 9,273,456 | B1 | 3/2016 | Miles et al. | |
| 9,371,938 | B2 | 6/2016 | Miskovich | |
| 9,556,579 | B2 | 1/2017 | Ahlberg et al. | |
| 9,850,647 | B1 | 12/2017 | Coppes et al. | |
| 9,889,986 | B2 | 2/2018 | Holbrook et al. | |
| 10,065,875 | B2 | 9/2018 | Potts | |
| D832,393 | S | 10/2018 | DiTullio et al. | |
| D840,499 | S | 2/2019 | DiTullio et al. | |
| 10,336,635 | B2 | 7/2019 | Couch | |
| 10,421,236 | B1 | 9/2019 | Moore, Jr. et al. | |
| 10,428,510 | B1 | 10/2019 | Moore, Jr. et al. | |
| 10,513,830 | B2 | 12/2019 | Coppes et al. | |
| 10,550,561 | B2 | 2/2020 | Potts et al. | |
| 10,570,602 | B2 | 2/2020 | Holbrook | |
| 10,696,448 | B1 | 6/2020 | Holbrook et al. | |
| 2002/0025226 | A1* | 2/2002 | Maestro | E03F 1/003 405/43 |
| 2002/0044833 | A1* | 4/2002 | Kruger | E03F 1/003 405/43 |
| 2004/0184884 | A1* | 9/2004 | DiTullio | E03F 1/003 138/121 |
| 2006/0233612 | A1* | 10/2006 | DiTullio | E03F 1/003 405/46 |
| 2007/0077122 | A1 | 4/2007 | Birchler et al. | |
| 2012/0264198 | A1 | 10/2012 | Hater et al. | |
| 2014/0212219 | A1 | 7/2014 | Jowett | |
| 2017/0015574 | A1 | 1/2017 | Potts | |
| 2017/0226729 | A1 | 8/2017 | Love et al. | |
| 2019/0316340 | A1 | 10/2019 | Holbrook | |
| 2020/0048889 | A1* | 2/2020 | DiTullio | B29C 51/10 |
| 2020/0385973 | A1 | 12/2020 | Trude et al. | |

FOREIGN PATENT DOCUMENTS

| | | |
|---|---|---|
| CA | 2450565 | 9/2004 |
| CA | 2743193 | 10/2013 |
| CA | 2747590 | 2/2014 |
| CN | 210658274 | 6/2020 |
| ES | 2217950 | 11/2004 |
| KR | 10-0771586 B1 * | 11/2007 |
| WO | WO2007099371 | 9/2007 |

OTHER PUBLICATIONS

Cardinal report for patentability search prepared on Jul. 13, 2021; 15 pgs.

Decentralized Systems Technology Fact Sheet, Septic Tank Leaching Chamber, Sep. 2000; U.S. Environmental Protection Agency; 7 pgs.

Gravelless, no-rock septic systems using geotextiles, Oct. 5, 2020; 7 pgs.

Dewatering and Utilization of Fly Ash Slurries Using Geotextile Tubes, Khachan et al, Jul. 20, 2012; 10 pgs.

Ads Arc 24 Leachfield Chamber—Ads 2412BD Septic Leaching Chamber, Advanced Drainage Systems; 2 pgs.

Quick4 Plus Standard Low Profile Chamber, Infiltrator Water Technologies; 2 pgs.

Quick4 Plus Standard Chamber, Infiltrator Water Technologies; 2 pgs.

Quick4 Plus Equalizer 36 Low Profile Chamber, Infiltrator Water Technologies, Apr. 2018; 2 pgs,.

Quick4 Plus All-in-One 8 Endcap, Infiltrator Water Technologies; 2 pgs.

Quick4 Plus High Capacity Chamber, Infiltrator Water Technologies; 2 pgs.

Quick4 Standard Chamber, Infiltrator Water Technologies; 2 pgs.

* cited by examiner

CHAMBER FOR SUBSOIL FLUID TREATMENT

BACKGROUND

The present disclosure relates generally to the field of subsoil fluid drainage, absorption and/or treatment systems, and more particularly to an "aggregate-free" chamber for accommodating and facilitating such drainage, absorption and treatment.

In a very general sense, subsoil chambers are installed in excavations to provide a volume for storage of water or other drainage fluid to prevent flooding as well as to treat the fluid. These chambers are occasionally referred to as "aggregate-free" solutions or products because installation and use does not require specialized layering of aggregate fill like some other fluid treatment solutions. Chambers include an outer shell formed from molded plastic that defines an empty or near empty interior volume and an open bottom.

Most known chamber systems require many different portions, sub-chamber units and/or connectors in order to allow flexibility and adjustability for different sizes and configurations. Some known chamber products that can vary in size necessarily include many different specific chamber units or sub-units that are required for assembly of a subsoil chamber. For example, a chamber may include a first end unit followed by several intermediate units, each having specific attachment features on their respective front and rear ends, followed by another end unit. Some products additionally require installation of a specific end cap to each respective ends. In assembling longer chambers, a different specific chamber unit is required for a specific portion of a chamber. Each of these sub-chamber units naturally require a separate mold to manufacture, provide a shipping challenge due to the numerous different forms of products, and necessarily require installers to precisely design their assemblies and order the correct pieces.

An additional drawback associated with known chamber products is that they are bulky and accordingly difficult to ship and handle. Additionally, many known chamber products are specifically designed as an all-in-one chamber unit that cannot be extended to achieve a longer chamber or altered in any way.

In all, existing chamber products and processes are cumbersome and lack substantial versatility in size, configuration and treatment mechanisms.

There is a need in the art for leaching chamber components that can be assembled into a variety of leaching chamber configurations from a limited number of standard components.

SUMMARY OF THE INVENTION

The disclosed embodiments of a leaching chamber unit improve upon known leaching chamber products by allowing construction of a variety of leaching chamber configurations from a single leaching chamber unit, without the need for specialized fittings. The disclosed embodiments are particularly adaptable to suit a number of different settings and needs, and in some cases, adaptable in size with individual chamber units having identical dimensions and not requiring differently configured units and/or sub-units.

Each of the disclosed leaching chamber units defines an interior space for receiving, and dispersing liquid, in particular effluent flowing from a septic system. The leaching chamber units have an elongated body with a length extending between a closed end and an open end. The closed end may define a fluid flow opening aligned with a longitudinal axis of the leaching chamber unit. An end wall of the closed end may be hemispherical or domed, or may be truncated and include a planar end wall including the fluid flow opening. The closed end of the leaching chamber unit may define one or more fluid flow openings. One or all of the openings may be provided by thinned or weakened portions of the end wall, which can be removed to receive fluid flow conduits to direct fluid into the leaching chamber. If not removed, the closed end of the leaching chamber unit remains closed, and does not need an end cap for closure. Alternatively, the fluid flow opening in the closed end of the leaching chamber unit may be open. The elongated body of the leaching chamber unit has an arcuate, arched or convex cross-sectional shape and includes strengthening ribs extending transverse to the length of the elongated body. The strengthening ribs are arranged in a regular, repeating pattern along the length of the elongated body. The strengthening ribs have a first profile facing an outer surface of the leaching chamber unit that is complementary to a second profile facing an inner surface of the leaching chamber unit. The repeating pattern and complementary shape of the strengthening ribs allow the disclosed leaching chamber units to be nested for storage and transport. The disclosed leaching chamber units can be mated with each other at a range of longitudinal positions to form leaching chamber assemblies of a desired interior volume and leaching capacity.

The disclosed leaching chamber units include openings in the side walls to allow fluid to flow from the interior space to soil surrounding the installed leaching chamber. The openings in the side walls are arranged to be aligned with each other when leaching chamber units are overlapped to form a leaching chamber assembly. The openings in the side walls may be configured to allow fluid and air flow out of the leaching chamber but also to resist intrusion of particulates. A louvered type opening where an upper portion of the side wall projects outwardly to define a downward facing opening will allow flow of water and air out of the leaching chamber, while preventing intrusion of particulates.

In some embodiments the openings in the side walls will require the leaching chamber assembly to be covered with geotextile fabric, commonly used in the assembly of leach fields. Once the leaching chamber and its fluid supply pipes or conduits have been assembled in an excavation such as a trench, a sheet or strip of geotextile fabric is used to cover the leaching chamber. The excavation is then back filled with soil or other material to hold the geotextile in place. The back fill also retains the leaching chamber units in their installed positions.

DETAILED DESCRIPTION

Figure 1:
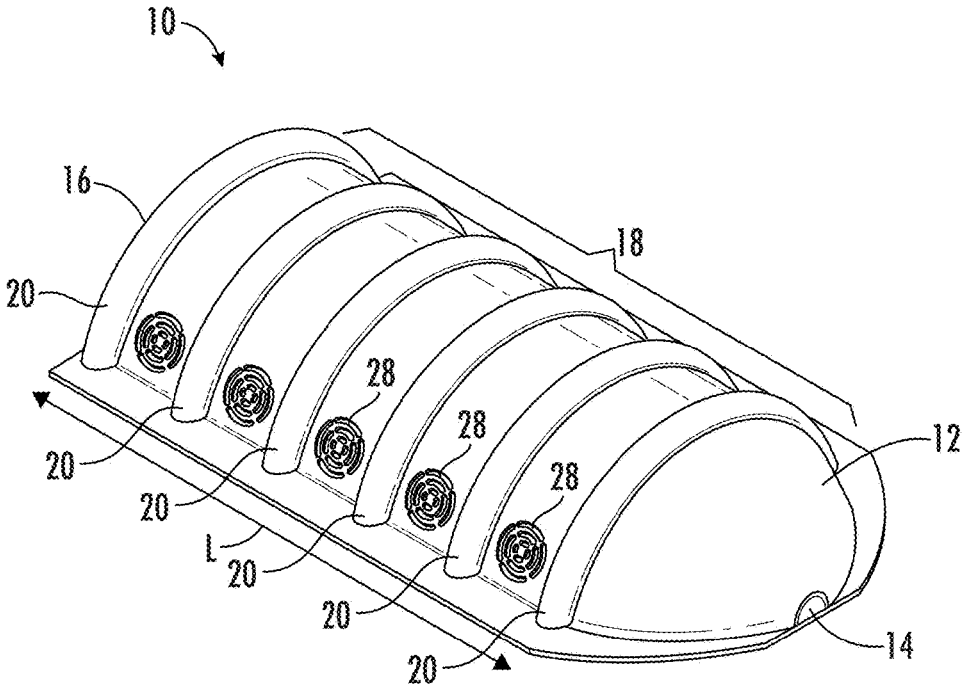
FIG. 1 is a top perspective view of a first embodiment of a leaching chamber unit according to aspects of the disclosure.

Leaching chamber units according to aspects of the disclosure will now be described with reference to FIGS. 1-17. The disclosed leaching chamber units may be constructed of molded plastic or thermoformed from a sheet of suitable thermoplastic material such as high-density polyethylene (HDPE), polyvinyl chloride (PVC), polyethylene terephthalate (PET), high-impact polystyrene (HIPS), acrylonitrile butadiene (ABS), or other materials known in the art. Other materials may be used to form the disclosed leaching chamber units. The material from which the leaching chamber units are constructed is selected on the basis of cost, durability in a septic leach field, and strength. The disclosed leaching chamber units are buried to form part of a fluid treatment system, and therefore are exposed to impact during installation, extreme temperatures, and various chemicals during use. The leaching chamber units must maintain their structural integrity beneath soil load and the weight of anything moving over the ground after the fluid treatment system is completed.

According to one aspect of the disclosure, leaching chambers of different volume and leaching capacity can be constructed from two or more identical leaching chamber units. The leaching chamber units are designed to nest together for storage and transport. The leaching chamber units are configured to interlock with each other at a plurality of longitudinal positions to form a wide range of leaching chambers of different length, interior volume and leaching capacity from identical leaching chamber units. The leaching chamber units have an arched configuration and define an open bottom interior space. In use, leaching chambers formed from two or more leaching chamber units are assembled in a trench with fluid conduits directing fluid flow into the interior space, where fluid is allowed to leach into the soil through the open bottom of the leaching chamber. Leaching chamber units may also define fluid flow openings along the sides to allow fluid to leach into soil surrounding the leaching chamber. Depending upon the configuration of the fluid flow openings in the side walls of the leaching chamber units, geotextile fabric (not shown) may be laid over the assembled leaching chamber and fluid supply pipes or conduits to prevent particulates from passing into the interior of the leaching chamber.

FIGS. 1-5 illustrate a first embodiment of a leaching chamber unit 10 according to aspects of the disclosure. The leaching chamber unit 10 has a closed end 12 defining a fluid flow opening 14 and an opposite open end 16. The fluid flow opening 14 may be surrounded by a weakened portion of the closed end 12 to allow removal as needed. The closed end 12 has a domed or hemispherical shape with inherent structural strength. A semi-cylindrical elongated body 18 has a length L extending between the closed end 12 and the open end 16. Regularly spaced convex strengthening ribs 20 extend across the elongated body 18, transverse to the length L of the leaching chamber unit 10. The strengthening ribs 20 have a convex profile 22 facing the outer surface of the leaching chamber unit 10, and a concave profile 24 facing the inside surface of the leaching chamber unit 10. The convex outer profile 22 is complementary to the concave inner profile 24, allowing the leaching chamber units 10 to mate with each other at a range of longitudinal positions. In the disclosed embodiments of a leaching chamber unit, the strengthening ribs 20 are illustrated as having a semi-circular cross section. Other cross-sectional configurations, such as polygonal cross-sectional shapes, may be used. The selected cross-sectional shapes should have complementary outer and inner profiles 22, 24 to allow nesting and interlocking of the leaching chamber units.

A laterally projecting flange or foot 26 extends along each side of the leaching chamber unit 10 and in the embodiment of FIGS. 1-5 extends around the closed end 12 to a point adjacent the fluid flow opening 14. Together, the strengthening ribs 20 increase the structural rigidity of the leaching chamber unit 10 to allow the unit to resist forces of soil load, etc. when buried. The laterally projecting flange 26 serves to support the leaching chamber unit 10 on the material beneath, which may be soil, gravel, sand, or other material, by spreading the force on the leaching chamber unit 10 over a large surface area. The illustrated fluid flow opening 14 is a semicircular opening intersecting with the lower edge of the leaching chamber unit 10, but the disclosed leaching chamber unit is not limited to this fluid flow opening shape. The fluid flow opening shape may be circular and located above the flange 26. The fluid flow opening 14 may take any form desired and compatible with fluid flow conduits delivering fluid to the leaching chamber unit.

Figure 2:
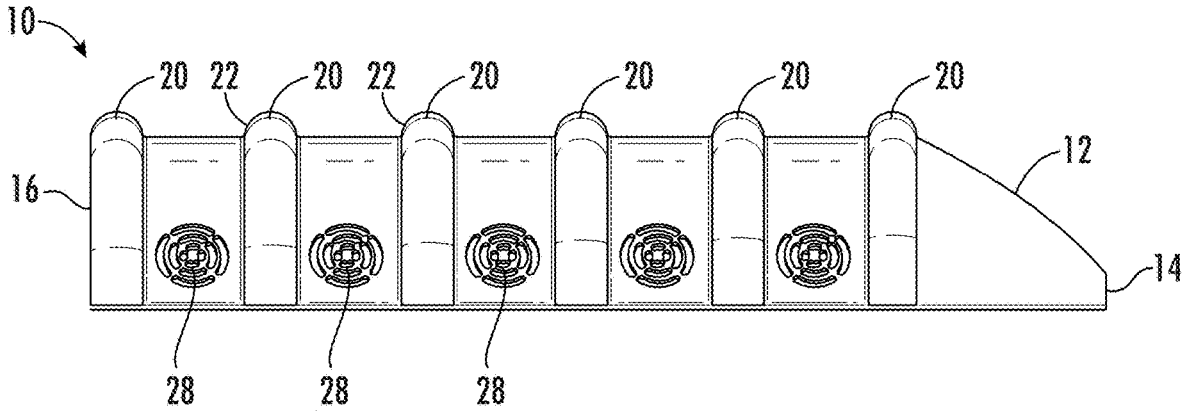
FIG. 2 is a side view of the leaching chamber unit of FIG. 1.
Figure 3:
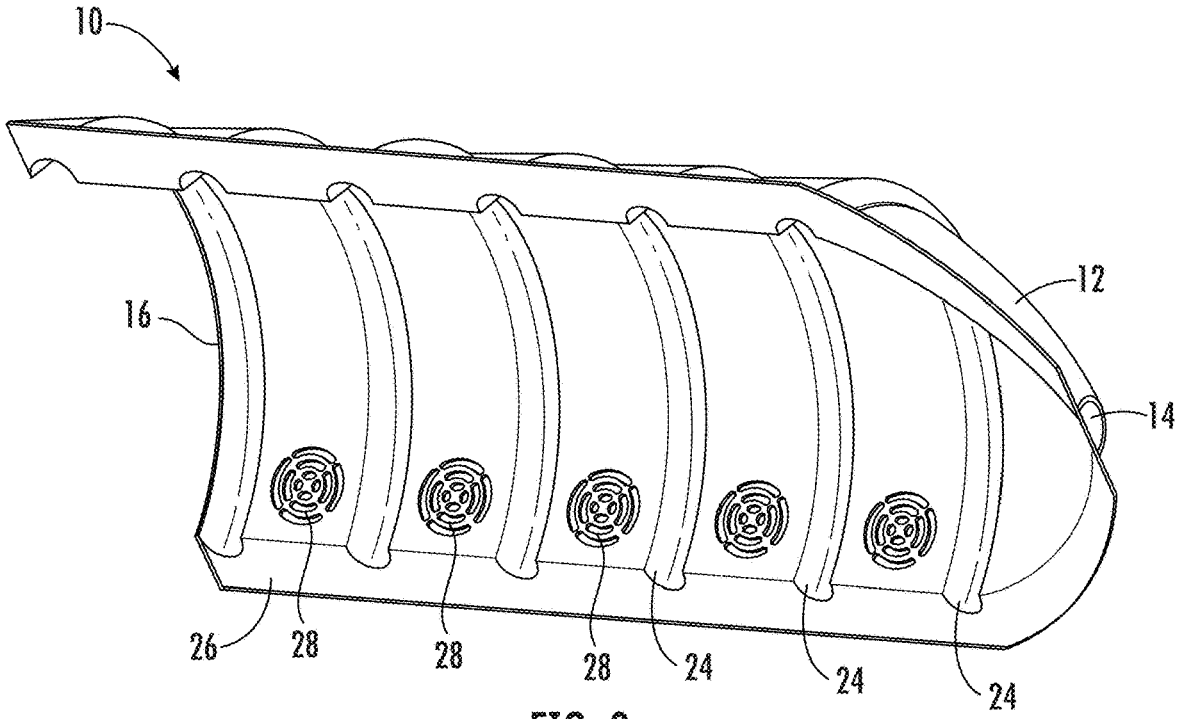
FIG. 3 is a bottom perspective view of the leaching chamber of FIGS. 1 and 2.
Figure 4:
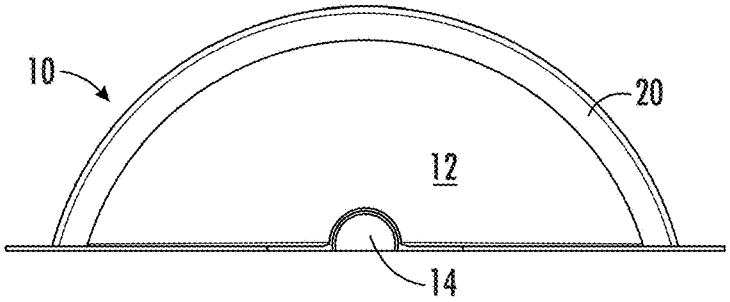
FIG. 4 is a right end view of the leaching chamber of FIGS. 1-3.
Figure 5:
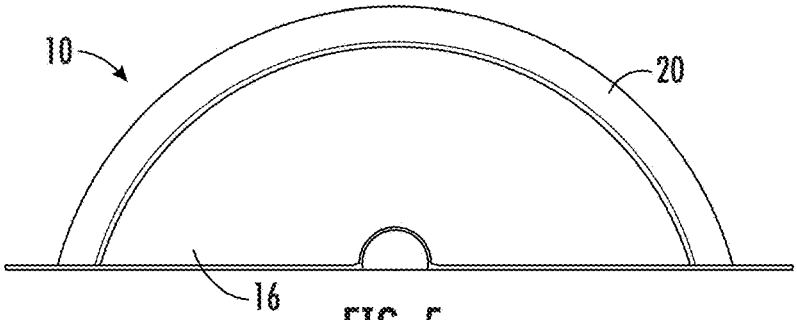
FIG. 5 is a left end view of the leaching chamber of FIGS. 1-3.
Figure 12:
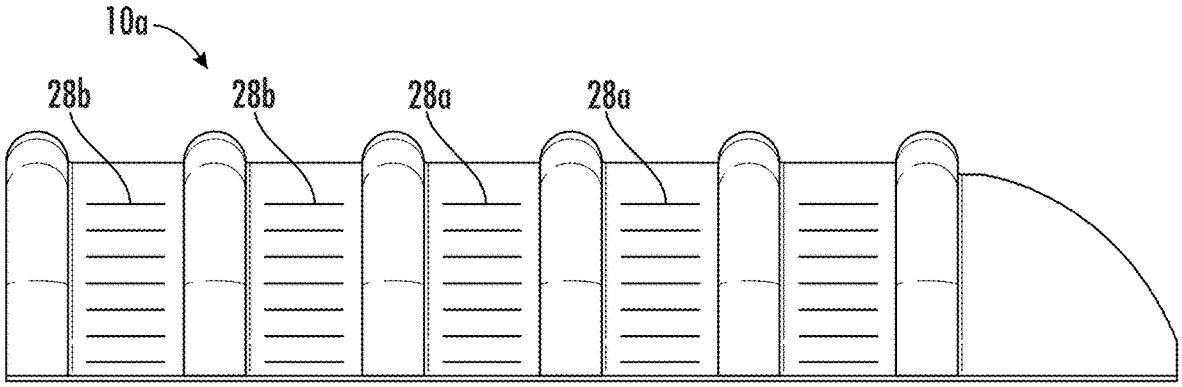
FIG. 12 is a side view of an alternative embodiment of a leaching chamber unit with louvered openings in the side wall according to aspects of the disclosure.
Figure 13:
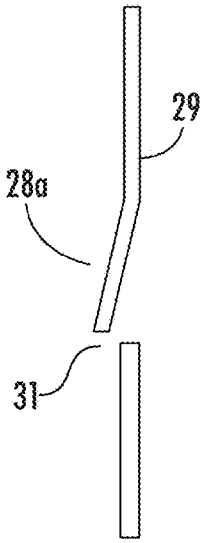
FIG. 13 is a sectional view through the side wall of the leaching chamber unit of FIG. 12, taken perpendicular to the length of the leaching chamber unit to show one example of a louvered opening.
Figure 14:
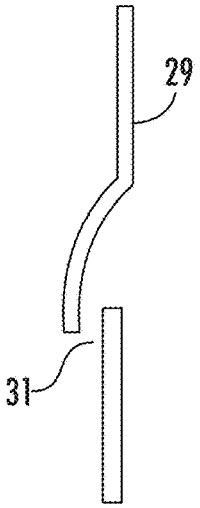
FIG. 14 is a sectional view through the side wall of the leaching chamber unit of FIG. 12, taken perpendicular to the length of the leaching chamber unit to show a second example of a louvered opening.

The leaching chamber unit 10 of FIGS. 1-5 defines a plurality of side openings 28 to allow fluid to flow out of the leaching chamber into surrounding soil. The side openings 28 shown in FIGS. 1-3 are punched through the side wall 29 of the leaching chamber unit 10, but the disclosed leaching chamber units are not limited to this kind of opening. A louver-type side opening that prevents soil intrusion into the leaching chamber may alternatively be employed as shown in FIGS. 12-14. The louvered openings 28*a*, 28*b* may be formed by cutting a slit in the side wall 29 of the leaching chamber unit 10*a* and then pushing the side wall 29 above the slit outward to define a downward facing opening 31 as shown in FIGS. 13 and 14. This form of opening allows fluid to flow out of the leaching chamber while preventing intrusion of particulates. A further alternative opening might be a pattern of small holes that will allow movement of liquid and air, but not allow intrusion of particulates. The disclosed side openings 28, 28*a*, 28*b* are centered between strengthening ribs 20. This arrangement aligns the side openings 28, 28*a*, 28*b* of overlapping leaching chamber units 10, 10*a* according to aspects of the disclosure.

Figure 6:
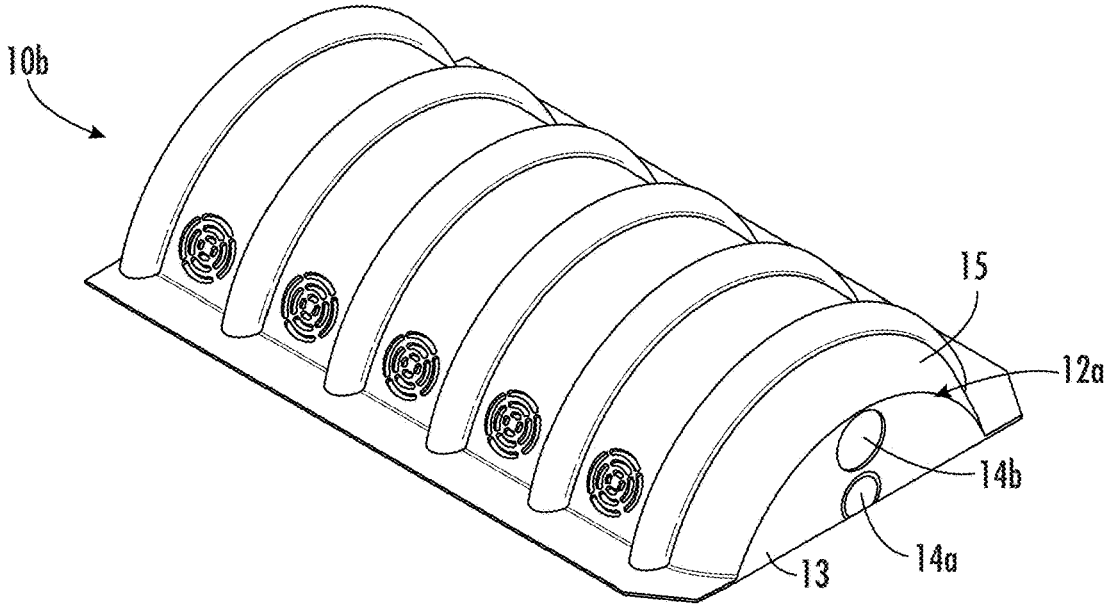
FIG. 6 is a top perspective view of a second embodiment of a leaching chamber unit according to aspects of the disclosure.
Figure 7:
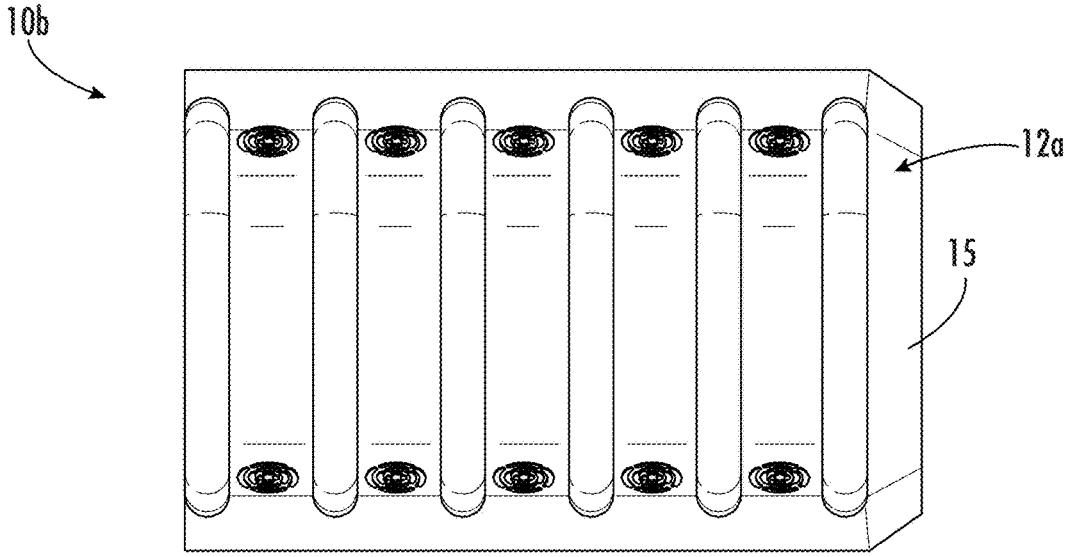
FIG. 7 is a top view of the leaching chamber unit of FIG. 6.
Figure 8:
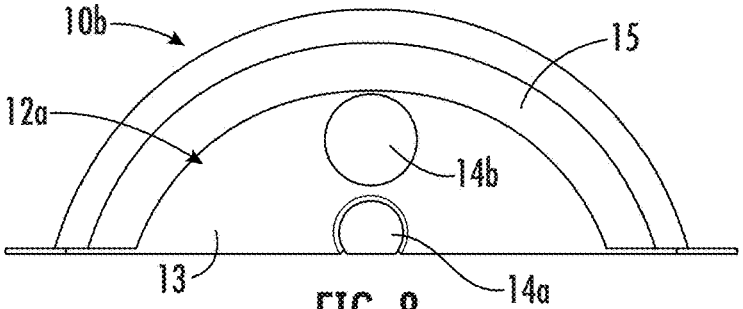
FIG. 8 is a right end view of the leaching chamber unit of FIGS. 6 and 7.

FIGS. 6-8 illustrate an alternative embodiment of a leaching chamber unit 10*b* according to aspects of the disclosure. The second embodiment of a leaching chamber unit 10*b* differs from the first embodiment of a leaching chamber unit 10 with regard to the shape of the closed end 12*a* and the configuration of fluid flow openings 14*a*, 14*b* in the closed end 12*a*. The closed end 12*a* of the leaching chamber unit 10*a* of FIGS. 6-8 is blunt or truncated rather than domed as in the leaching chamber unit 10 of FIGS. 1-5. The closed end 12*a* defines two fluid flow openings 14*a*, 14*b*, defined by weakened portions of the closed end, one circular opening 14*b* arranged above a semi-circular opening 14*a*. The thinned or weakened portions defining the openings 14*a*, 14*b* can be cut or broken as needed to allow insertion of a fluid flow conduit or to allow fluid to flow between adjacent leaching chambers. The closed end 12*a* includes a planar end wall 13 and angled wall portion 15 that enhance the rigidity of the closed end 12*a* of the leaching chamber unit 10*a*. In all other respects, the leaching chamber unit 10*a* of FIGS. 6-8 is substantially identical to the leaching chamber unit 10 of FIGS. 1-5 in terms of structure and function.

Figure 9:
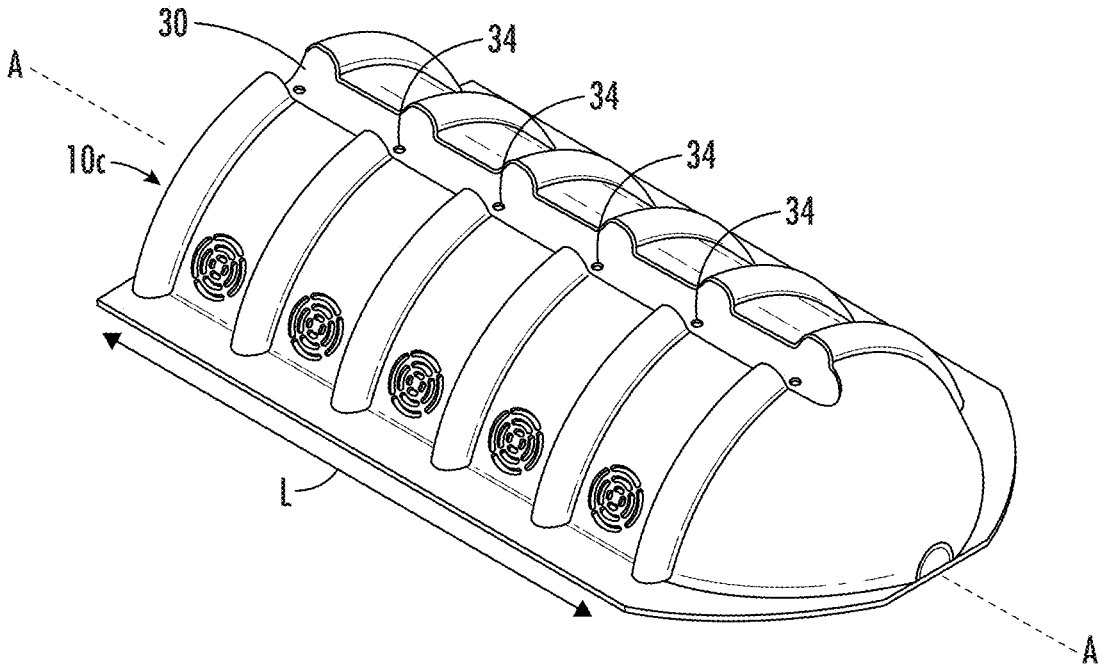
FIG. 9 is a top perspective view of a third embodiment of a leaching chamber unit according to aspects of the disclosure.
Figure 10:
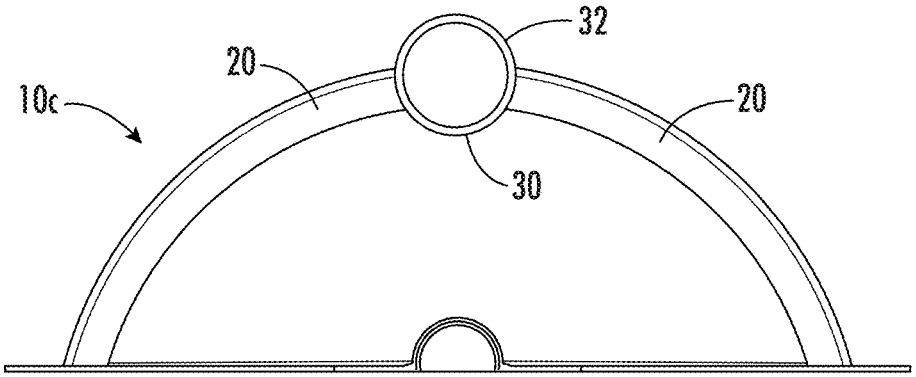
FIG. 10 is a right end view of the leaching chamber unit of FIG. 9.

FIGS. 9 and 10 illustrate a third embodiment of a leaching chamber unit 10*c* according to aspects of the disclosure. In this embodiment, the elongated body 18 and closed end 12 have the same basic form as the leaching chamber unit 10 illustrated in FIGS. 1-5. The leaching chamber unit 10*c* of FIGS. 9 and 10 defines a channel 30 extending the entire length L of the leaching chamber unit 10*c*. The channel 30 is aligned with a longitudinal axis A-A of the leaching chamber unit 10*c* and is configured to match the outer contour of a conduit or pipe 32 for distribution of effluent. The channel 30 defines a plurality of holes 34 through which effluent from the pipe 32 flows to the interior of the leaching chamber unit 10*c*. The holes 34 in channel 30 may be aligned with holes in the pipe for more efficient transfer of effluent from the pipe 32 to the interior of the leaching chamber unit 10*c*. Distribution of fluid into a leaching chamber using a pipe laid in a channel allow fluid to be distributed along the length L of the leaching chamber, in contrast to fluid delivery through a fluid flow opening in the closed end 12, 12*a* of a leaching chamber unit 10, 10*a*, 10*b*. The shape of the channel 30 illustrated in FIGS. 9 and 10 may be configured so that a pipe 32 in the channel 30 will maintain separation of the upper ends of the reinforcing ribs 20 and enhance the structural integrity of the leaching chamber unit 10*c* for support of the pipe 32.

Figure 17:
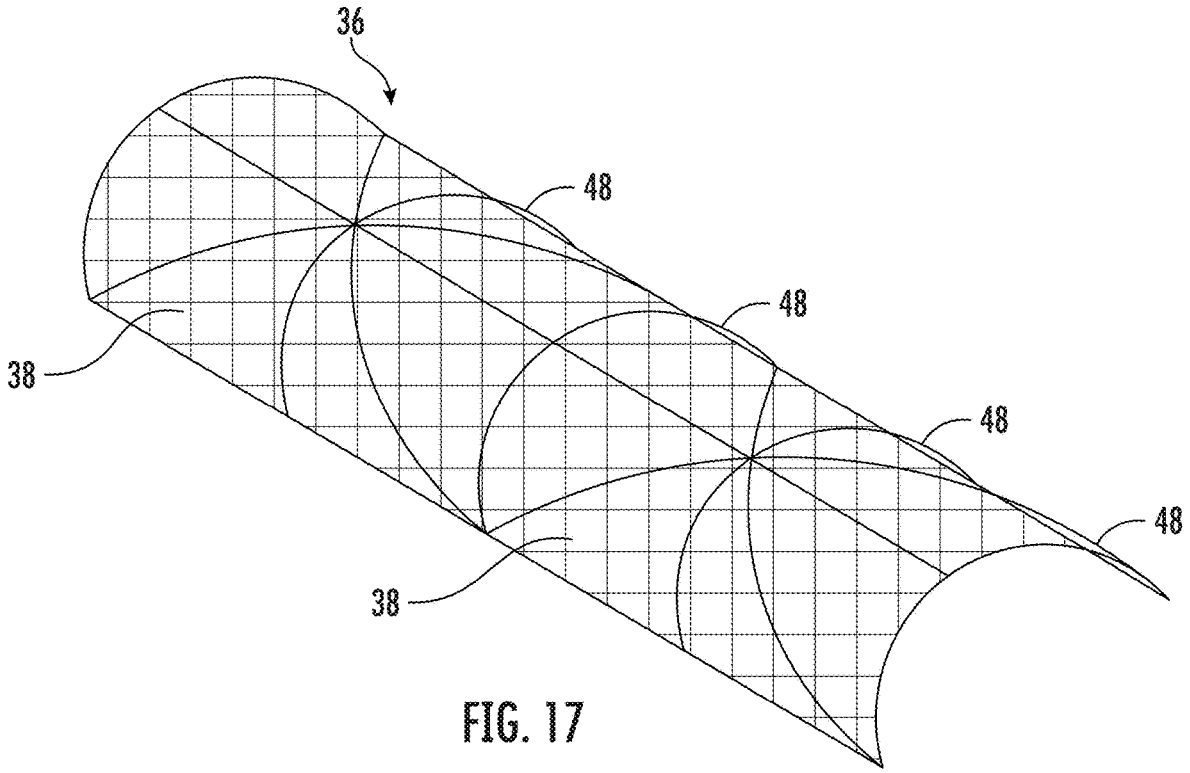
FIG. 17 is a top perspective view of a leaching chamber unit in the form of an arched grid that when covered with a geotextile fabric defines a leaching chamber according to aspects of the disclosure.

FIG. 17 illustrates a further alternative leaching chamber unit 36 according to aspects of the disclosure. The leaching chamber unit 36 is an arch shaped grid with openings through the side wall 38 across the top as well as the sides of the leaching chamber unit 36. The arched body of the leaching chamber unit 36 includes hollow strengthening ribs 48 that provide structural rigidity connected by a side wall 38 in the form of a grid. As in other embodiments, the strengthening ribs 48 are arranged in a repeating pattern and configured to allow the leaching chamber units 36 to be engaged with each other at a range of overlapping positions. Overlapping the leaching chamber units 36 allows leaching chamber assemblies of different lengths to be constructed. Leaching chamber units 36 may be overlapped for additional resistance to weight of back fill or vehicles passing over the leaching chamber. Geotextile fabric is used to cover the leaching chamber units 36 to form a leaching chamber with openings over the top and sides that allows fluid and air to enter and leave the leaching chamber in all directions.

Figure 11:
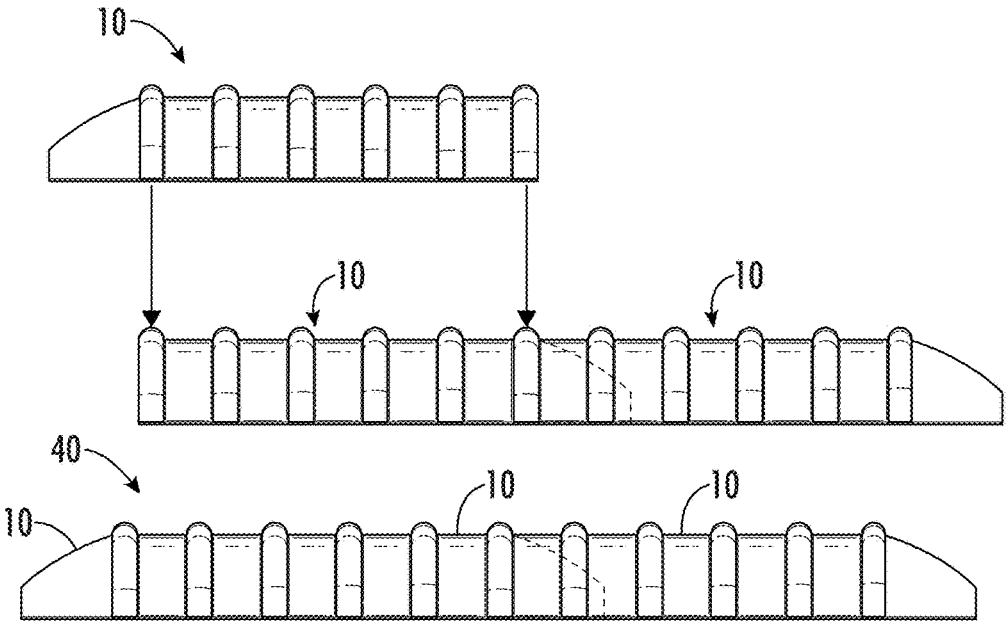
FIG. 11 illustrates a representative leaching chamber assembly including a plurality of leaching chamber units according to aspects of the disclosure.
Figure 15:
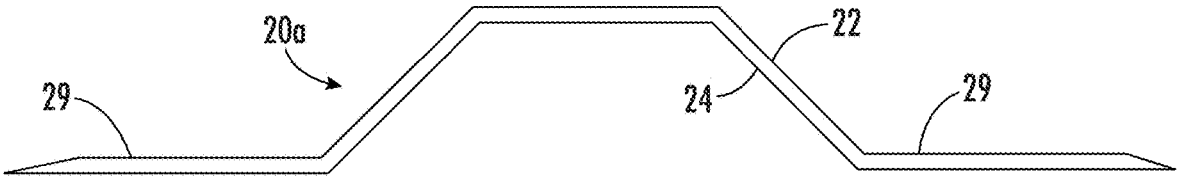
FIG. 15 is a longitudinal sectional view through a strengthening rib and adjacent portions of the side wall of a leaching chamber unit to show an example of a polygonal strengthening rib according to aspects of the disclosure.
Figure 16:
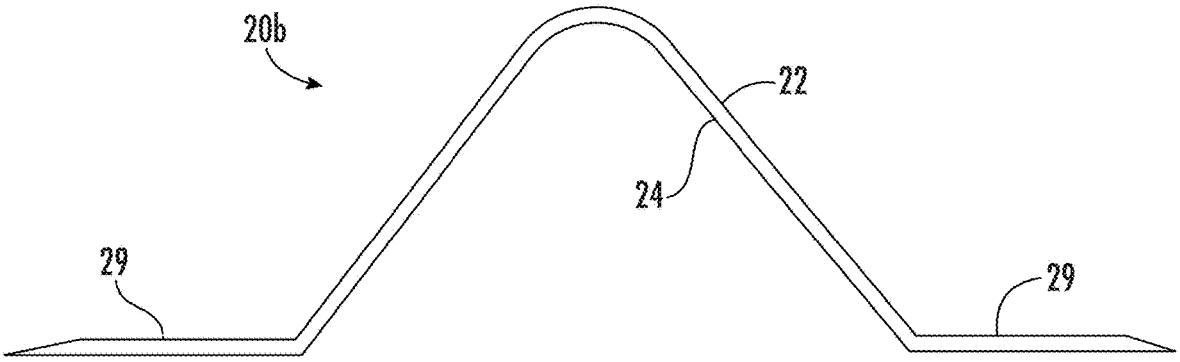
FIG. 16 is a longitudinal sectional view through a strengthening rib and adjacent portions of the side wall of a leaching chamber unit to show a second example of a polygonal strengthening rib according to aspects of the disclosure.

All the disclosed leaching chamber units 10, 10*a*, 10*b*, 10*c*, and 36 are configured to be nestable for storage and transport. All the disclosed leaching chamber units are configured to mate with each other in a range of overlapping longitudinal positions as shown in FIG. 11. A series of identical leaching chamber units can be overlapped to form a leaching chamber assembly of any desired length without the need for specialized connectors. A stock of one leaching chamber unit can be used to produce a wide variety of leaching chamber assemblies, reducing the cost and complexity of inventory of parts needed for constructing leaching chambers of different interior volume and leaching capacity. Mating one leaching chamber unit with another leaching chamber unit is made possible by the complementary configuration of the profile of the strengthening ribs. The convex profile 22 of the strengthening ribs facing an outside surface of the leaching chamber unit are receivable in the concave profile 24 of the strengthening ribs facing an inside surface of the leaching chamber unit. FIGS. 15 and 16 illustrate alternative configurations of strengthening ribs 20*a*, 20*b* having a polygonal profile. The complementary outer and inner profiles 22, 24 are nestable for storage and transportation and are complementary to each other for engagement at a range of longitudinal positions. The strengthening ribs 20, 20*a*, 20*b*, 48 are regularly spaced along the length of the leaching chamber unit, so that the ribs interfit with each other at a range of longitudinal positions. The leaching chamber units may be longitudinally positioned to overlap and interfit one or all the strengthening ribs. This permits two of the disclosed leaching chamber units to form a leaching chamber assembly having a length of one leaching chamber unit or up to approximately a length of two leaching chamber units.

All the disclosed leaching chamber units are also reversible and can be mated with another leaching chamber unit with the closed end of a leaching chamber unit within the interior of another leaching chamber unit as shown in FIG. 11. The closed end 12, 12*a* of a leaching chamber unit has more structural integrity than an open end of a leaching chamber unit, so positioning the closed end of a leaching chamber unit within the interior space of another leaching chamber unit enhances the structural integrity of the leaching chamber assembly 40. When two leaching chamber units overlap at their open ends, the nested reinforcing ribs support each other, resulting in a leaching chamber assembly 40 with greater resistance to soil load. The greater the overlap between leaching chamber units, the greater the strength of the leaching chamber assembly. This feature of the disclosed leaching chamber units can be used to configure leaching chamber assemblies having a desired load-supporting capacity, depending upon the depth and other parameters of the installed leaching chamber. The symmetrical arrangement of fluid flow openings in the sides of the disclosed leaching chamber units ensure that the openings of the leaching chamber units align in any of the longitudinal overlapping positions when they are nested to form a leaching chamber assembly.

What is claimed:

1. A leaching chamber unit for constructing a leaching chamber to receive, and disperse liquid, said leaching chamber unit comprising:

an elongated body having a length extending between a first end and a second end, the first end including an end wall defining an opening and the second end being open, said elongated body having an arcuate cross-sectional shape defining an interior and including strengthening ribs extending transverse to the length of the elongated body, said strengthening ribs arranged in a repeating pattern along the length of the elongated body, said elongated body defining an outwardly facing concave pipe channel extending from the first end to the second end, said pipe channel arranged along a longitudinal center line of the elongated body, said pipe channel interrupting said strengthening ribs and including a plurality of fluid flow openings communicating with the interior, wherein each of said strengthening ribs has an outwardly facing first convex profile and an inwardly facing concave profile facing the interior of the elongated body, said convex profile complementary to and receivable in said concave profile of another said leaching chamber unit, said leaching chamber unit being nestable in other said leaching chamber units for storage and transport and mateable with another said leaching chamber unit at a plurality of relative longitudinal positions with at least one of said strengthening rib convex profiles receivable in at least one of said strengthening rib concave profiles to connect two or more of said leaching chamber units to form a leaching chamber.

2. The leaching chamber unit of claim 1, wherein side walls of the elongated body define openings to allow movement of air and liquid away from the interior of the leaching chamber unit when buried.

3. The leaching chamber unit of claim 1, comprising a foot extending laterally from a lower edge of the elongated body, said foot extending along the length of the elongated body from the first end to the second end.

4. A leaching chamber assembly comprising:

a plurality of identical chamber units, each chamber unit having an elongated body with a length between an open end and a closed end defining a fluid flow opening, said elongated body having an arcuate cross-sectional shape between flanges projecting away from the elongated body along said length, the elongated body defining an interior space open at the bottom, said elongated body including reinforcing ribs arranged in a repeating pattern, wherein the chamber units overlap each other and the reinforcing ribs of one chamber unit interfit with the reinforcing ribs of an adjacent chamber unit to connect the adjacent chamber units in a selected longitudinal position relative to each other and the plurality of chamber units are connected with the closed end of a first chamber unit at a first end of the leaching chamber assembly and the closed end of a second chamber unit at a second end of the leaching chamber assembly, with at least one chamber unit between the first chamber unit and the second chamber unit, the at least one chamber unit having the closed end positioned within a leaching chamber defined by the leaching chamber assembly.

5. The leaching chamber assembly of claim 4, wherein the reinforcing ribs have an outwardly facing first profile and an inwardly facing second profile, said first profile complementary to and said second profile to connect the chamber units at the selected longitudinal position.

6. The leaching chamber assembly of claim 4, wherein said at least one chamber unit comprises a plurality of chamber units selected to define a leaching chamber having a desired interior volume and leaching capacity.

7. The leaching chamber assembly of claim 4, wherein the repeating pattern of reinforcing ribs permits each of the plurality of chamber units to overlap with an adjacent chamber unit to an extent selected from a maximum overlap corresponding to the entire length of a chamber unit to a minimum overlap corresponding to interfit of one reinforcing rib of a chamber unit with one reinforcing rib of an adjacent chamber unit, permitting an interior volume and leaching capacity of the leaching chamber assembly to be configured by selecting the number and extent of overlap between the plurality of chamber units.

8. The leaching chamber assembly of claim 7, wherein the leaching chamber assembly includes a plurality of intermediate chamber units between the first and second chamber units, the closed end of the plurality of intermediate chamber units providing enhanced resistance to soil load and other forces on an outside surface of the leaching chamber.

9. The leaching chamber assembly of claim 4, wherein fluid enters the leaching chamber through the fluid flow opening of the closed end of one of the chamber units.

10. The leaching chamber assembly of claim 4, wherein each chamber unit includes a longitudinal concave pipe channel extending from the closed end to the open end, said pipe channel including a plurality of fluid flow openings communicating with the interior space.

11. A leaching chamber assembly comprising:

a plurality of identical chamber units, each chamber unit having an elongated body with a length between an open end and a closed end defining a fluid flow opening, said elongated body having an arcuate cross-sectional shape between flanges projecting away from the elongated body along said length, the elongated body defining an interior space open at the bottom, said elongated body including reinforcing ribs arranged in a repeating pattern, wherein the reinforcing ribs of one chamber unit interfit with the reinforcing ribs of an adjacent chamber unit to connect adjacent chamber units in a selected longitudinal position relative to each other, said repeating pattern of reinforcing ribs permitting adjacent chamber units to overlap each other to an extent selected from a maximum overlap corresponding to all the reinforcing ribs of a first chamber unit overlapping with all the reinforcing ribs of a second chamber unit to a minimum overlap corresponding to one reinforcing rib of the first chamber unit overlapping with one reinforcing rib of the second chamber unit, an interior volume and leaching capacity of a leaching chamber defined by the leaching chamber assembly and configured by selecting the extent of overlap between the first and second chamber units.

12. The leaching chamber assembly of claim 11, wherein each chamber unit includes a longitudinal concave pipe channel extending from the closed end to the open end, said pipe channel including a plurality of fluid flow openings communicating with the interior space.

13. The leaching chamber assembly of claim 11, wherein fluid enters the leaching chamber through the fluid flow opening of the closed end of one of the chamber units.

14. The leaching chamber assembly of claim 11, wherein the plurality of identical chamber units comprises a plurality of intermediate chamber units between the first and second chamber units, the closed end of the plurality of intermediate chamber units providing enhanced resistance to soil load and other forces on an outside surface of the leaching chamber.

15. The leaching chamber assembly of claim 11, wherein side walls of each chamber unit define openings to allow movement of air and liquid away from the interior volume of the leaching chamber assembly when buried.

16. The leaching chamber of claim 11, wherein the closed end of the first chamber unit forms a first end of the leaching chamber and the closed end of the second chamber unit forms a second end of the leaching chamber.

* * * * *